US007175537B2

(12) United States Patent
Pollman

(10) Patent No.: US 7,175,537 B2
(45) Date of Patent: Feb. 13, 2007

(54) GOLF PUTTER WITH LIFT ANGLE

(76) Inventor: Frederic W Pollman, 18975 Ellie La., Eden Prairie, MN (US) 55346

( * ) Notice: Subject to any disclaimer, the term of this patent is extended or adjusted under 35 U.S.C. 154(b) by 0 days.

(21) Appl. No.: 11/145,088

(22) Filed: Jun. 6, 2005

(65) Prior Publication Data

US 2005/0227778 A1 Oct. 13, 2005

Related U.S. Application Data

(62) Division of application No. 10/384,490, filed on Mar. 7, 2003, now Pat. No. 6,988,959.

(51) Int. Cl.
*A63B 53/14* (2006.01)
*A63B 53/04* (2006.01)

(52) U.S. Cl. ..... 473/203; 473/313; 473/340; 473/292; 473/328

(58) Field of Classification Search ..... 473/313, 473/340–341, 292, 328, 293, 203
See application file for complete search history.

(56) References Cited

U.S. PATENT DOCUMENTS

| | | | | | |
|---|---|---|---|---|---|
| 823,082 | A | * | 6/1906 | Robertson | 473/340 |
| 1,459,810 | A | * | 6/1923 | Wills | 473/343 |
| 1,703,199 | A | * | 2/1929 | McClure | 473/243 |
| 3,679,207 | A | * | 7/1972 | Florian | 473/292 |
| 3,966,210 | A | * | 6/1976 | Rozmus | 473/341 |
| 4,010,958 | A | * | 3/1977 | Long | 473/341 |
| 4,138,117 | A | | 2/1979 | Dalton | |
| 4,141,556 | A | * | 2/1979 | Paulin | 473/253 |
| 4,173,343 | A | * | 11/1979 | Richilano | 473/251 |
| 4,253,667 | A | | 3/1981 | Clark et al. | |
| 4,422,638 | A | | 12/1983 | Tucker | |
| 4,702,477 | A | | 10/1987 | Solomon | |
| 4,754,976 | A | | 7/1988 | Pelz | |
| 4,795,158 | A | * | 1/1989 | Kuykendall | 473/201 |
| 4,964,639 | A | | 10/1990 | Tucker | |
| 5,072,941 | A | | 12/1991 | Klein | |
| 5,160,141 | A | * | 11/1992 | Crews | 473/313 |
| 5,176,379 | A | | 1/1993 | Reinberg | |
| 5,213,332 | A | | 5/1993 | Fahy et al. | |
| 5,228,332 | A | | 7/1993 | Bernhardt | |
| 5,324,031 | A | | 6/1994 | Green | |
| 5,458,332 | A | | 10/1995 | Fisher | |
| 5,615,884 | A | | 4/1997 | Modglin | |
| 5,685,784 | A | * | 11/1997 | Butler | 473/340 |
| 5,938,538 | A | | 8/1999 | Broadbridge et al. | |
| 5,976,025 | A | * | 11/1999 | Williams | 473/252 |
| 5,993,324 | A | | 11/1999 | Gammil | |

(Continued)

*Primary Examiner*—Sebastiano Passaniti

(57) ABSTRACT

A putter has a center of gravity located rearward from the face and under the stroking pivot point. The polar moment of inertia of the putter is increased by moving the distribution of weight toward the rear of the head away from the contact surface. The sole of the putter has an optimized transverse radius and a raised front edge. The putter has an aiming mark that has a minimum area and a minimum length-to-width ratio and is brightly colored. The putter grip has a flat portion that is oriented to match the player's hand rotational position. The face of the putter has friction and energy transfer characteristics that are selected to influence ball motion if struck with stroking errors. The face loft angle cooperates with the face surface characteristics to influence ball launch angle and rotation.

15 Claims, 10 Drawing Sheets

U.S. PATENT DOCUMENTS

| | | | | |
|---|---|---|---|---|
| 5,993,330 | A | 11/1999 | Akerstrom | |
| 6,080,070 | A | 6/2000 | Whitley | |
| 6,123,625 | A * | 9/2000 | Koblentz | 473/203 |
| 6,203,443 | B1 | 3/2001 | Britton | |
| 6,273,827 | B1 * | 8/2001 | Hockerson et al. | 473/236 |
| 6,350,208 | B1 | 2/2002 | Ford | |
| 6,406,379 | B1 | 6/2002 | Christensen | |
| 6,447,403 | B1 | 9/2002 | Schmidt | |
| 6,471,600 | B2 | 10/2002 | Tang et al. | |
| 6,497,626 | B1 | 12/2002 | Sundberg | |
| 6,695,708 | B2 | 2/2004 | Fisher | |
| 6,716,110 | B1 | 4/2004 | Ballow | |
| 6,767,292 | B1 | 7/2004 | Skalla | |

* cited by examiner

GOLF PUTTER WITH LIFT ANGLE

This application is a division of Ser. No. 10/384,490, filed Mar. 7, 2003, now U.S. Pat. No. 6,988,959.

BACKGROUND OF THE INVENTION

This invention generally relates to golf clubs and specifically to clubs for putting a golf ball into a hole.

Publications providing specifications, instruction and other data in the field of putting include "The Rules of Golf" from the United States Golf Association (2002), "Dave Pelz's Putting Bible" from Doubleday (2000), and "The Ultimate Clubmakers Catalog" from Golfsmith International, LP (2003).

Putting is a major component of scoring in the game of golf, often comprising about 40% of the strokes used. Putting is a precise activity with a very low error required for holing most putts. As putting requires low force but high accuracy, improvements for putters have greatest potential in facilitating a good stance and proper aim, and consistent stroking of the putter. The degree of achieving these requirements will vary with the skill level of the player as well as with playing conditions.

The putter disclosed herein has a weight distribution and form which enhances the player's ability to take a good stance and to minimize the potential or effect of mis-hits. It has an aiming mark which maximizes the player's ability to visualize alignment with the aimline, and a grip configuration which promotes consistent club face orientation and stroking direction. Further, this putter has a face with friction and energy transfer characteristics that corrects for errors in club face orientation or directional errors in stroking the putter, and it enhances ball motion after stroking.

Prior configurations have disclosed putters with the center of gravity in line with the intended impact point with the golf ball in order to help prevent putter face twisting for off-center hits, or to achieve a certain hitting characteristic. For instance see U.S. Pat. No. 5,938,538—Broadridge et al. (1999) that discloses a transverse and horizontal center of gravity location coincident with the ball strike point and shaft axis extension. However, the extension of the shaft axis intersects longitudinally near the front face, requiring some side resisting force from a player to keep the putter in the proper position. This shaft position relative to the center of gravity also promotes twisting of the putter on the backstroke. A further disadvantage of this longitudinal location of the shaft is to place the ball back in the stance, making aiming a putt more difficult. U.S. Pat. No. 6,350,208 B1—Ford (2002) has a larger head with the center of gravity vertically in line with the shaft hosel. However, the shaft is close to the strike face, still keeping the ball undesirably forward in the stance. A center of gravity close to the face also has the negative result of reducing the polar moment of inertia. Ford '208 is silent on the how the player positions the stance. U.S. Pat. No. 4,701,477—Solomon (1987) has the shaft rearward of the face but the center of gravity is forward of the shaft, creating a need for a resisting force when taking a stance. This increases tension in the player's hands and arms. Further, a shaft position behind the center of gravity promotes twisting of the putter on the downstroke. U.S. Pat. No. 4,754,976—Pelz (1988) discloses a putter with a special weight positioned away from the face that increases the polar moment of inertia. However, this putter cannot be made in one piece, which increases cost. None of these patents disclose how the center of gravity should be located with respect to the player and the pivot point of the swing, and none show inertia weighting that meets cost and dimensional requirements.

Many putters have soles which are curved transversely, for instance U.S. Pat. No. 4,141,556—Paulin (1979). This patent does not disclose any relationship to a player's stance and does not have a small enough transverse radius to allow for an ideal stance for some players. U.S. Pat. No. 6,406,379—Christensen (2002) has a smaller transverse radius, but its value is too large to optimize the hitting area when the putter is tipped transversely.

There are a variety of aiming marks disclosed for putters including that in U.S. Pat. No. 5,993,330—Akerstrom (1999). It has an alignment stripe that has a small length to width ratio making it difficult to establish directionality, and the color is not specified. U.S. Pat. No. 5,072,941—Klein (1991) discloses a wide sighting surface which is yellow on a black background, and which has a narrow black groove in the center. The wide surface has a small length to width ratio, and the small groove is too small to visualize accurately. The sighting surface in Klein '941 is also in three sections making it difficult to focus on that surface. U.S. Pat. No. 5,615,884—Modglin (1997) discloses a long alignment notch but which is too narrow and too small in area for clear visual focus, and which does not extend frontward to the top of the putter face.

Putter grips are routinely supplied with an axial flat portion that is aligned parallel to the direction of stroking. These current putters do not align the grip flat with any particular portion of a player's hand to allow accurate rotational orientation of the putter.

There are various surface conditions for a putter face now in use including various metals and elastomers. Also, several US Patents show materials that are intended to improve the player's perception of the ball striking process. For instance see U.S. Pat. No. 6,471,600 B2—Tang, et al. (2002) that has a polyurethane insert on the putter face, to which no particular function is ascribed. U.S. Pat. No. 5,458,332—Fisher (1995) discloses a putter face of polyurethane material of various hardness levels. These different hardness levels allow different rebound factors to change the feel and stroking force requirements. None of these references disclose a putter face with special friction characteristics and none identify any influence on ball direction or roll.

U.S. Pat. No. 6,497,626 B2—Sundberg (2002) and others show a putter face inclination of about 4° from vertical in order to provide a small amount of ball lift. No putters are disclosed which show a relationship of ball lift and roll with putter geometry and face surface condition.

SUMMARY OF THE INVENTION

A putter is disclosed which assists the player in taking a stance, in aiming and stroking, and that reduces negative effects on ball direction due to errors in stroking. It has a center of gravity and striking face position that enable a player to take a stance with the eyes behind the ball and above the aimline, and to promote a square face when stroking. The sole of the putter has a small, optimized radius to enable taking an upright stance or for use on sidehill lies, and to reduce drag if used in deep grass. An aiming mark is provided which enables clear focus of directionality to assist in aligning the putter and the player's stance with the aimline. The polar moment of inertia is increased to assist in keeping the face perpendicular to the aimline with off-center hits. A grip with a specially positioned flat is provided to assist in aligning the putter with the player's stance. The striking face has friction and energy transfer characteristics that influence ball direction when striking the ball to help correct for mis-hits and improve ball motion.

It is therefore an objective to provide an improved putter that assists in positioning the player and the putter, focusing the perception of the target, and optimizing the putter physical characteristics to correct for swing errors. A further objective of this putter is for it to be easily used by people of various skill levels and enhance their ability to reduce the number of putts required to hole a golf ball. It is also an objective of this putter to conform to "The Rules of Golf" as published by the United States Golf Association. These and other objectives will be apparent to those skilled in the art.

DETAILED DESCRIPTION OF THE INVENTION

A Player's Stance and Aim. When putting a golf ball, a proper stance is necessary preparation for striking the ball. It is generally agreed by experts that the eyes of the player should be vertically over the aimline in order to provide the most accurate vision of it, and that alignment of the player's feet with the aimline is necessary for consistent stroking of the putter. Many experts counsel minimum muscle use during stroking of a putter in order to minimize errors. For many players, having the eyes over the aimline and using minimum muscles leads to an upright stance with the arms hanging loosely and the legs and back muscles supporting minimum overhung weight. Further, it is easier to align two objects, such as the ball and the aimline, from a single direction rather than to look backward and forward. Aligning the ball and the aimline from one direction leads to a stance that places the player's eyes behind the ball. Consistent orientation of the putter in the player's hands is necessary for consistently accurate stroking.

A potential difficulty with putters is to allow a sufficiently upright stance for players with the shaft lie angle being limited by the USGA. Further, putters generally have a center of gravity that is located vertically behind or ahead of the pivot point of the stroke motion so that muscle tension is required when holding the putter in place in a stance. A relaxed stance promotes less movement during the striking process and leads to less fatigue and strain on a player's back. A putter that provides an aiming mark which is distinctive and easy to focus on, and that provides for accurate directionality in aiming the putter, and for placing the player's feet in alignment with the aimline, would be an improvement over the current choices.

When stroking the putter, there are a variety of errors which a player can precipitate. Among these are putter face twisting, and stroking off the aimline in either angle or position. Reducing the effect of these errors would be an improvement. Inducing roll in the ball when striking it would reduce skidding and provide better speed control.

Figure 1:
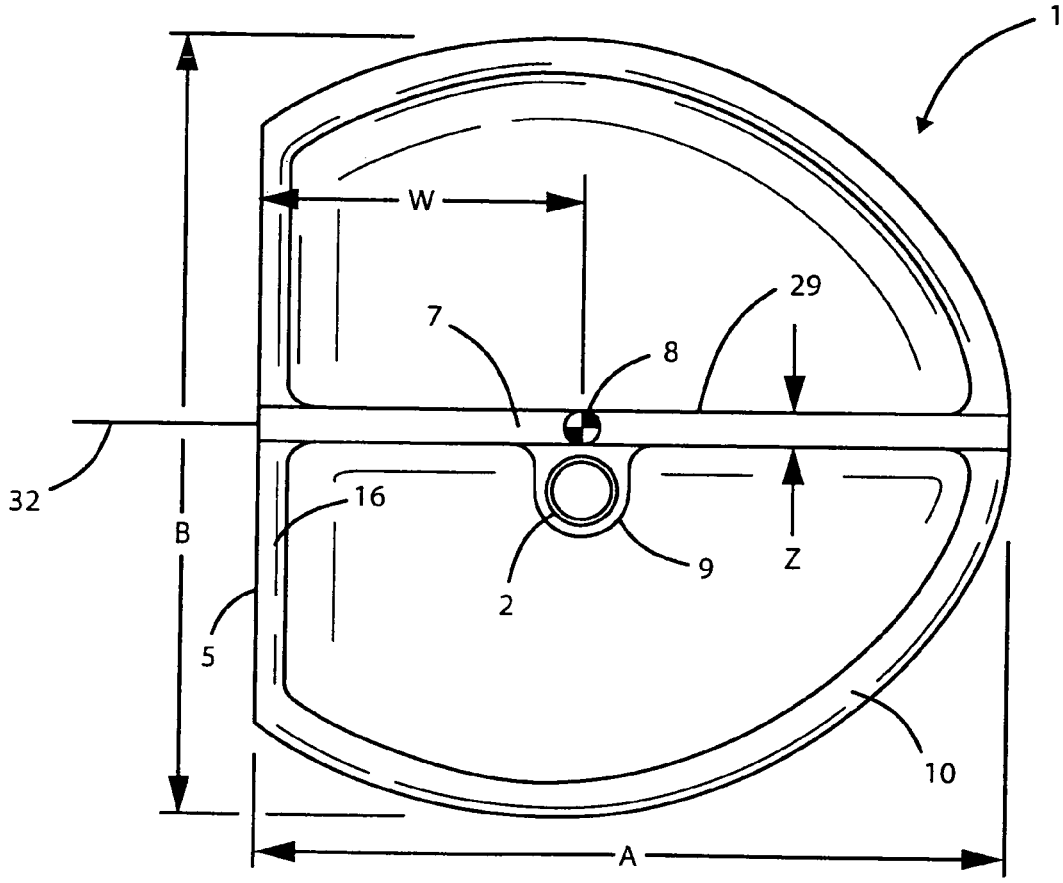
FIG. 1 is a plan view of a putter head with a sectioned shaft.

Description of a Putter Head with Shaft. With reference to FIG. 1, a putter head 1 has a generally circular shape but with varying radii. Head 1 is substantially symmetrical and is shown for a right-handed player. A flat front face 5 is used to strike a ball, and may be less in width than other sections of head 1. A weighted rim 10 extends around the head perimeter except where strike face 5 is located. Rim 10 is located substantially away from the center of strike face 5. The polar moment of inertia varies with the square of the distance from the rotational axis. As the center of face 5 is the rotational axis when striking a ball, the tendency for head 1 to rotate during a mis-hit is resisted more so than with conventional heel and toe weighted putters.

The weight of head 1 varies with the player preference and the type of putter, and may be about 325 g. for conventional free held putters. There may be higher weight values for stomach supported and pendulum-style putters. Head 1 is one piece, and may be cast, machined, or both cast and machined. Head 1 may be made from a number of materials including stainless steel, zinc alloy, titanium alloy, aluminum alloy or other materials. The material selection depends on the size and weight of head 1, and potentially the friction and energy transfer characteristics of face 5. Face 5 may have a surface treatment to change its frictional or energy transfer characteristics. Various other constructions of head 1 are possible including an inverted structure with the continuous surface on top and the intermittent surface on the bottom.

A center of gravity 8 is located at the transverse center of head 1, placing it in a vertical plane directly behind the intended ball strike point. It is located at a longitudinal location W behind face 5. As location W is also used to establish the pivot point of the stroke, the center of gravity 8 is placed far enough behind strike face 5 to allow a player's eyes to be behind the ball when taking a relaxed stance. The typical eye spacing for an adult player is less than 3.4 in. Therefore, c.g. location W should be at least 1.7 in. to place both eyes behind the ball. For this configuration of head 1, location W is 42% of a head length A.

A hosel 9 is located near to, but offset from, the transverse center of head 1, enough to keep an aiming mark 7 continuous, and contains a bore for a shaft 2. Hosel 9 may be located longitudinally wherever it is convenient, provided dimensional conditions relating to center of gravity 8 are met. Hosel 9 would be on the opposite side of aiming mark 7 for a left-handed player.

Aiming mark 7 is located at the transverse center of head 1, in the direction of stroking, and is at a right angle to face 5. Aiming mark 7 is supported on a longitudinal rib 29, which also provides bracing for a sole 6 and face 5. In use, aiming mark 7 would normally be aligned with an imaginary aimline 32 of the putt. Aimline 32 is the intended direction of the ball immediately after being struck by the putter. Aiming mark 7 provides a single focus for the eyes and mind of the player in order to establish directionality of the putter, the stance, and the stroke. Aiming mark 7 is generally rectangular in shape, and is of sufficient proportions to facilitate a clear image. Aiming mark 7 is not too large to prevent easy focusing and establishment of direction, and is a simple pattern to provide clear information. Except for potential small construction related gaps at the ends, aiming mark 7 establishes head length A, and is preferably between 3.0 in. and 6.0 in. long. A width Z of aiming mark 7 is at least 0.12 in. Aiming mark 7 has a length to width ratio A/Z at least 18:1, and a minimum area A×Z of 0.50 $in^2$. Aiming mark 7 is a bright color that reflects a high percentage of incident light. This would include colors such as safety yellow, iridescent yellow, or white, and preferably with a glossy finish. The balance of the visible top surface of head 1 is a dark, dull color that absorbs a high percentage of incident light. This would include colors such as black, dark gray, or dark green and preferably with a flat or satin finish. Aiming mark 7 has generally parallel sides but may be tapered. Aiming mark 7 may be raised above a surrounding surface 16, or be flush or depressed, but is preferably continuous. A regular pattern of small dots or stripes, with minimal open space, would be considered continuous. In accordance with USGA rules, a head width B is greater than length A.

Figure 2:
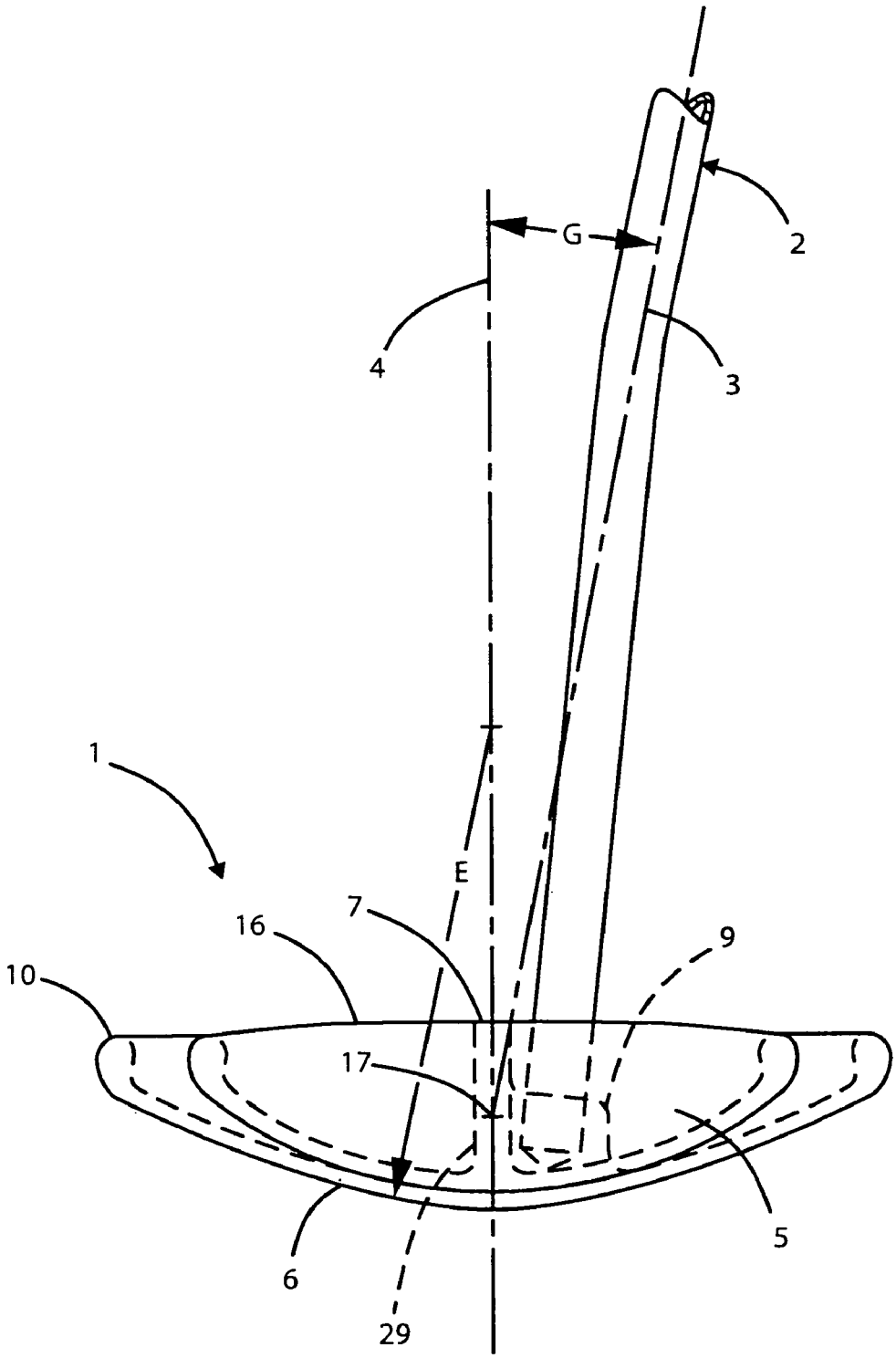
FIG. 2 is a front view of the putter head of FIG. 1 with a partial shaft attached.
Figure 3:
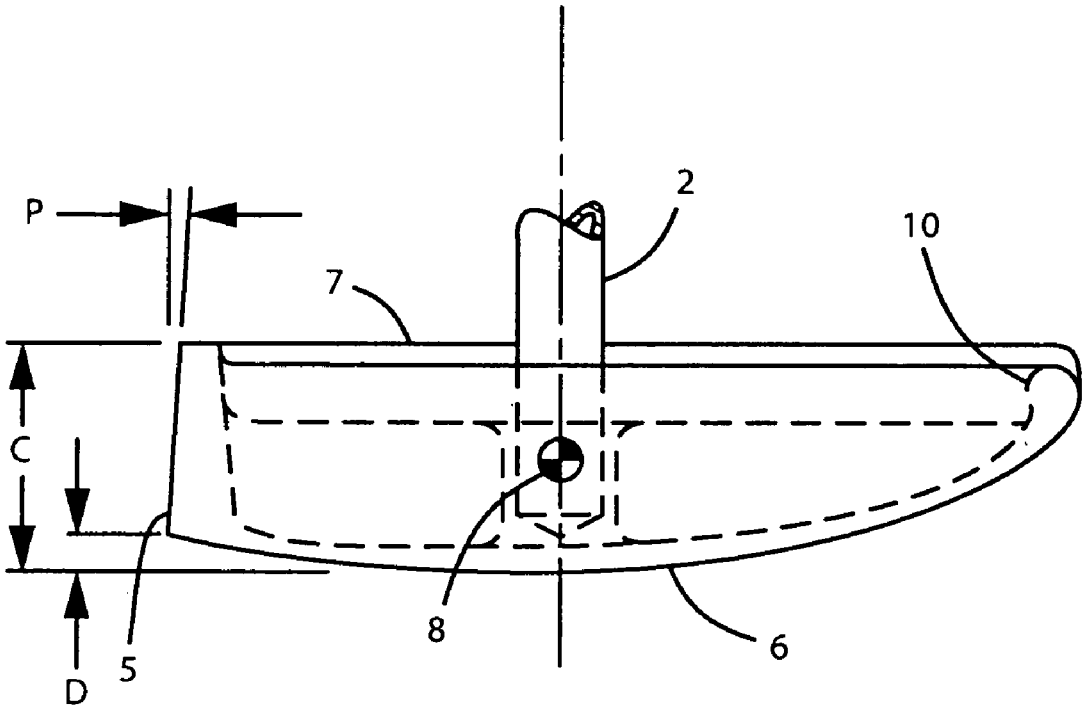
FIG. 3 is a left-side view of the putter head of FIG. 1 with a partial shaft attached.

In FIGS. 2 and 3, shaft 2 is generally straight but has one or more bends near hosel 9 in order to facilitate attachment. In accordance with USGA rules, these bends are less than 5.0 in. from the bottom of a sole 6. Shaft 2 is generally cylindrical and is preferably tubular and is made from steel. Shaft 2 may be a Rifle FM PRECISION STEPLESS model with a bend added, or other similar part. Shaft 2 is fixed permanently to head 1 at hosel 9 with adhesive or other suitable means. A longitudinal plane 3 bisects shaft 2 above the bend point and passes through a vertical longitudinal plane 4 at the vertical height of a ball strike point 17. Plane 3 is at a lie angle G measured from vertical plane 4. Lie angle G may be determined by player preference, but in any case would be at least 10° in conformance with USGA rules, and would not exceed 20°. Small values of lie angle G lead to an upright stance and lesser use of back and leg muscles. Higher values of lie angle G lead to a curved stance and more use of muscles. Shaft 2 length from sole 6 would vary with player preference and according to the style of putter, but would be about 34 in. for a conventional free held putter, about 42 in. for a stomach supported putter, and about 54 in. for a chest supported pendulum putter.

Face 5 has a height C that is about 1.0 in. Intended strike point 17 is located about halfway up face height C and is in line with vertical plane 4. Strike point 17 height is less than half the ball diameter because the putter is lifted off the ground when stroking. Weighted rim 10 is positioned vertically to locate center of gravity 8 in line horizontally with strike point 17. With center of gravity 8 positioned in line with the strike point 17 in both the longitudinal and horizontal planes, and shaft longitudinal plane 3 coincident with strike point 17, both head 1 momentum force and the player's applied strike force are aligned with the ball resisting force. The result is minimal tendency for head 1 to rotate when striking the ball. Face 5 has a loft angle P that is shown positive but which may be zero or negative. Loft angle P would not exceed 10° in conformance with USGA rules. The selection of loft angle P is influenced by the friction and energy transfer characteristics of face 5, and by the stroking arc of face 5.

Sole 6 has a maximum radius E in the transverse plane for a minimum of + or − 10° arc from vertical plane 4. Radius E is sized to maximize the hitting area around strike point 17 and sole 6 when head 1 is level or is tilted transversely. Tilting of head 1 with shaft 2 allows for variations in foot position relative to putter head 1 and aimline 32, or for use on sidehill greens. A small sole radius E also reduces motion resistance to the putter if used in taller grass off the green. Sole radius E may be approximated by a series of flat segments, or by segments with a larger radius, or by one segment and open spaces. Sole 6 in the longitudinal direction is curved to match a rise D of face 5 and the lower portion of rim 10 at the rear. Rise D is provided for stroking arc ground clearance as the stroke pivot point is rearward of face 5 and above center of gravity 8. Rise D would be about 0.07 in. for c.g. location W of 1.8 in., based on a 25 in. stroking radius. Sole 6 material is thin in order to minimize its weight and transfer weight to rim 10.

Figure 14:
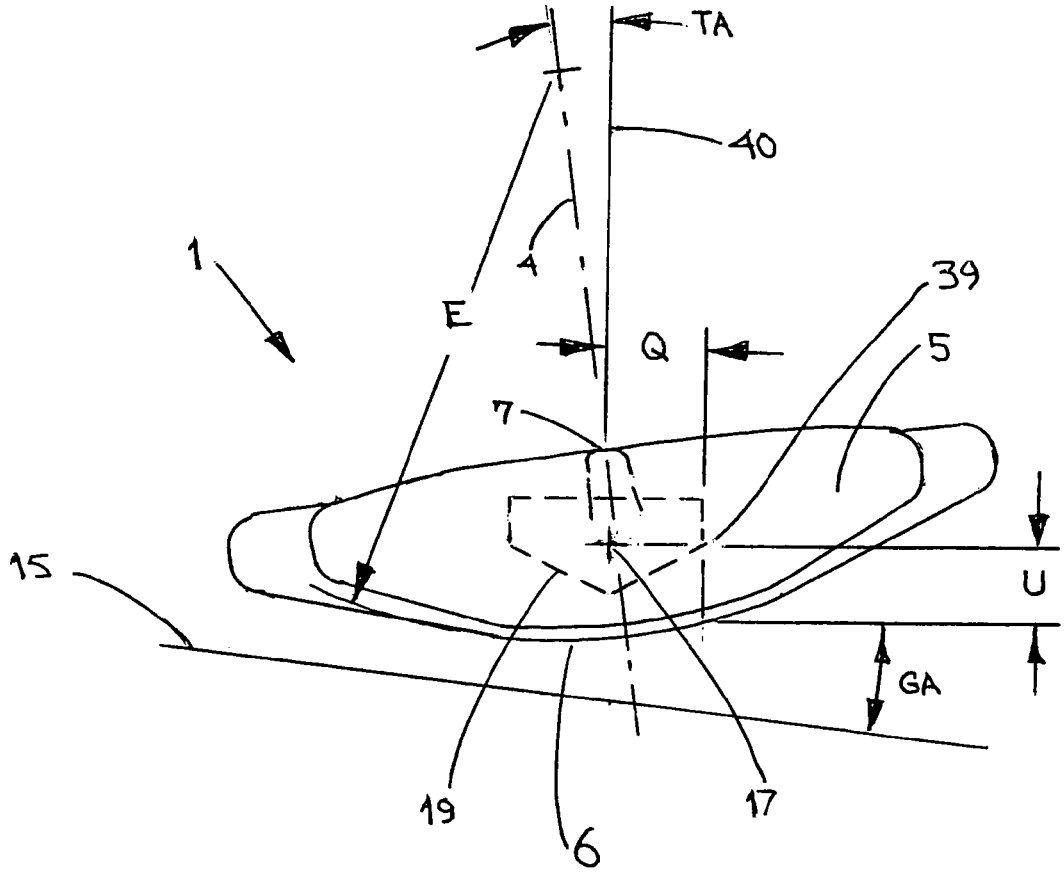
FIG. 14 is a view if the putter head of FIG. 2 in a tilted position with a ball strike area shown.

In FIG. 14, plane 4 of head 1 is shown tilted from its normal position 40 by angle TA due to a player's preference. A ground surface 15 is off level by an angle GA. For this illustration, angle TA and angle GA total 10°, the minimum arc length for radius E on sole 6. Head 1 is raised from ground 15 in a strike position. Strike point 17 on face 5 is vertically aligned with aiming mark 7. A strike area 19 surrounds strike point 17 and is bounded on either side by a half-width Q. Strike area 19 encloses the pattern of strike points for ball 14. A corner 39 is formed by half-width Q and the lower boundary of strike area 19. A clearance height U is the vertical distance from corner 39 of strike area 19 to sole 6. In this case, corner 39 is referenced to strike point 17. Alternatively, corner 39 could be referenced lower on face 5 with a different shape strike area 19. Clearance U varies with the magnitude of radius E. For smaller values of radius E, clearance U is smaller by the reduction of sole 6 boundary on face 5 near corner 39. For larger values of radius E, clearance U is smaller because head 1 pivots on ground 15 on the opposite side of corner 39. An optimum value exists where clearance U is maximized.

Half-width Q is about 0.50 in. for medium and high handicap players. Corner 39 of strike area 19 moves lower with increasing handicaps but does not extend further out. By plane geometry, clearance U is maximized with radius E between 3.0 in. and 3.4 in., when angles TA and GA total 10°. Clearance U, referenced to strike point 17, is about 0.41 in. when radius E in this range. For values of radius E outside this range, clearance U decreases. If corner 39 were closer to sole 6, radius E would still be optimized in the same range, as sole 6 would not change position. For any combination of angle TA and angle GA not totaling 10°, the optimum range for radius E would change.

Half-width Q is smaller for low handicap players and clearance U is not an issue.

Figure 4:
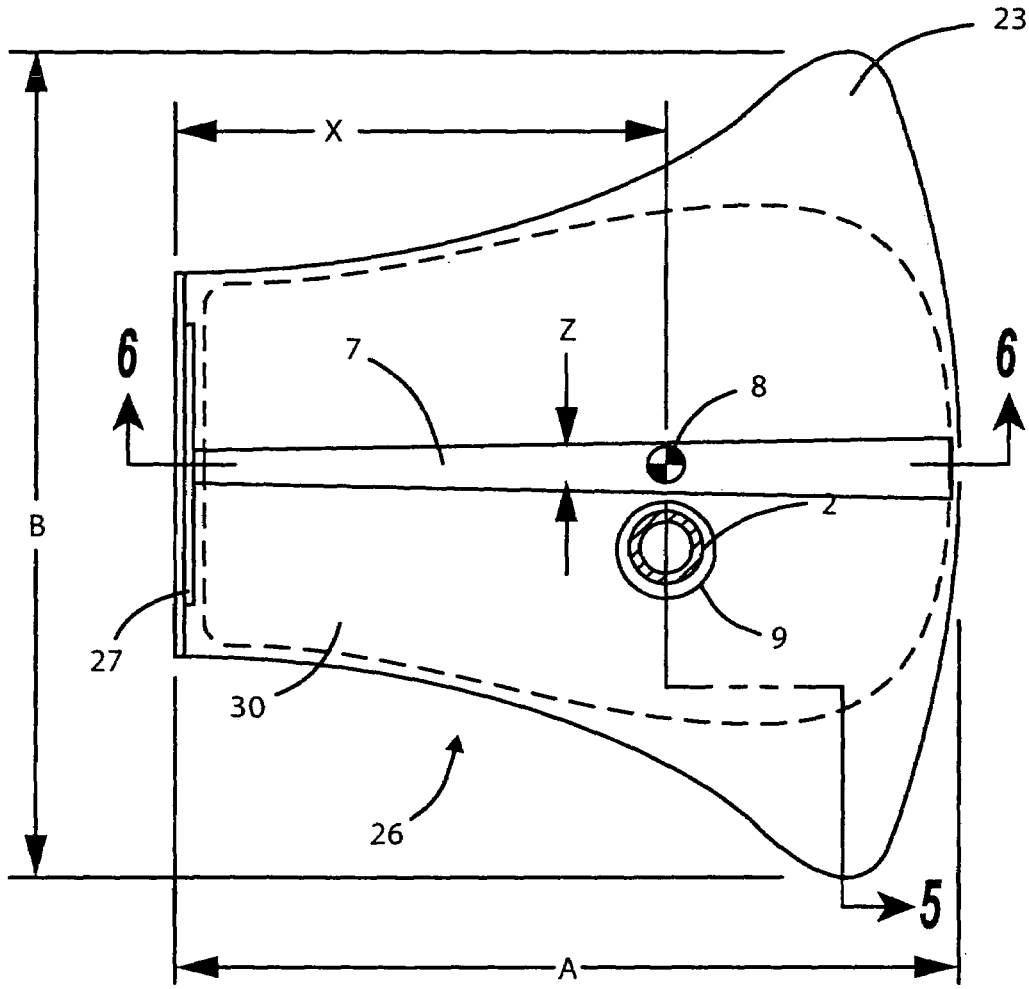
FIG. 4 is a plan view of a putter head with a sectioned shaft having a different shape and construction than FIG. 1.
Figure 5:
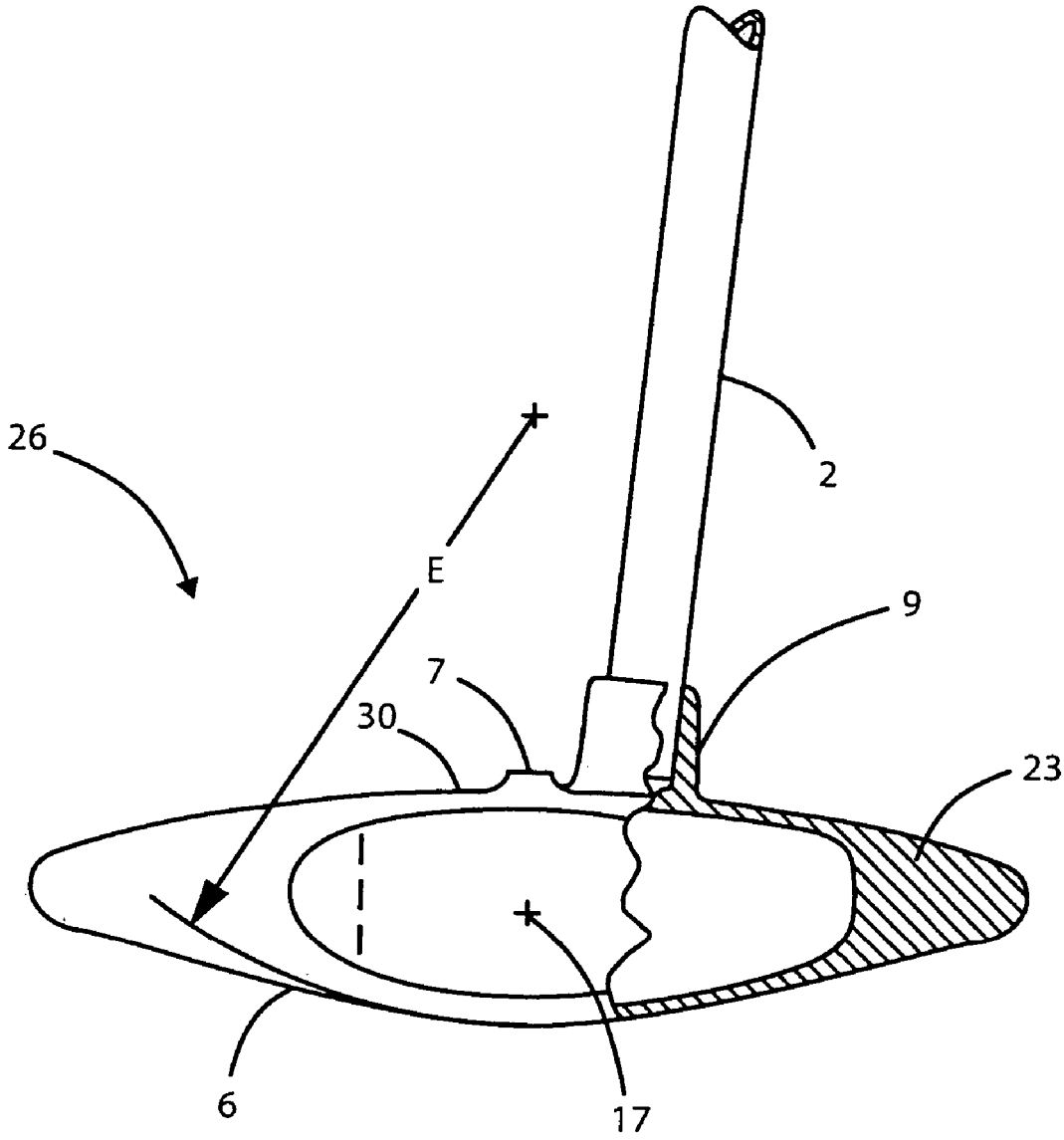
FIG. 5 is a front view and partial cut-away of the putter head of FIG. 4 with a partial shaft attached.
Figure 6:
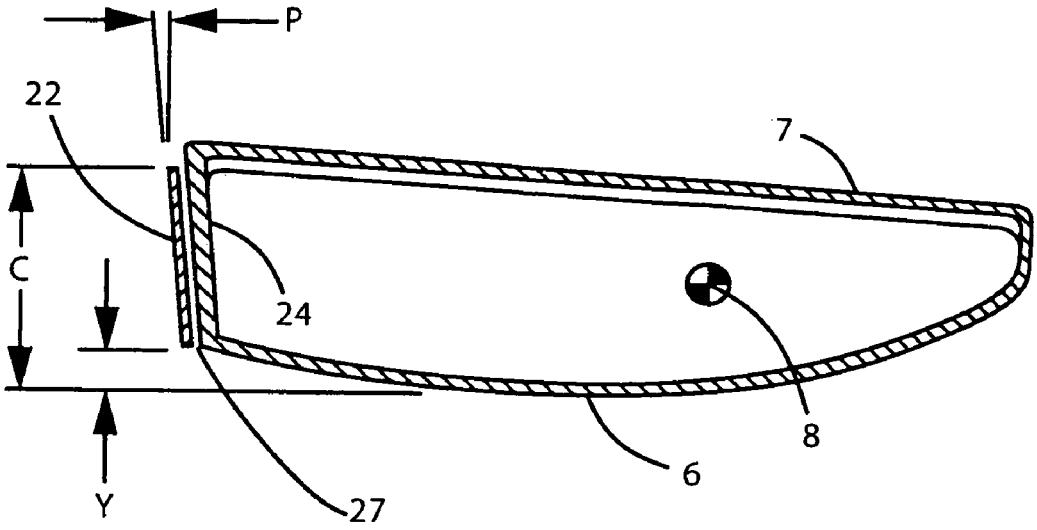
FIG. 6 is a left-side cut-away view of the putter head of FIG. 4.

Description of an Alternative Putter Head with Shaft. FIGS. 4, 5 and 6 are views of a second putter head 26. Head 26 has a different shape than head 1 to alter the weight distribution and the location of center of gravity 8. Head 26 has an alternate construction of a putter face 22, as well as other features. Features that are identified with the same number or letter as in FIGS. 1–3 serve the same purpose and would have similar descriptive text, and are therefore not repeated.

From the top, head 26 appears as a flattened, truncated teardrop that is somewhat T-shaped. The top part of the T-shape is at the rear of head 26. Head 26 is a shell construction, from at least two pieces, and may be made from the same materials as head 1. Processing of head 26 parts may include forging or stamping. Parts would be welded or heat fused together, or adhesively attached.

Head 26 is weighted at the rear, away from putter face 22, with a single or multiple weights 23. This has the effect of moving center of gravity 8 away from face 22 and moving the swing pivot point back. C.g. location X is about 45% greater than c.g. location W from FIG. 1. For this configuration of head 26, location X is about 62% of length A. This places the player's stance further behind the ball for more accurate visibility of aimline 32. It also increases the lift angle of the strike force, allowing a smaller or more negative loft angle P, both resulting in more topspin on a ball.

Weights 23 are located vertically to achieve center of gravity 8 at the same elevation as strike point 17. Weighting which is located at the rear of head 26 could also be achieved with the one-piece construction of FIGS. 1–3, but the plan view shape would be similar to FIG. 4. Other constructions are possible that would meet the specifications described herein, including an inverted one-piece head with a continuous surface on top and a longitudinal strip for the sole. Weights 23 could be distributed in one segment along the back surface of head 26.

Rise Y at the bottom of face 22, is higher than rise D from FIG. 3 because the increased location X dimension requires more ground clearance. For c.g. location X dimension of 2.5 in., rise Y is about 0.13 in. Loft angle P is shown negative in FIG. 6 but could be zero or positive.

In FIG. 4, aiming mark 7 is drawn with a tapered width, preferably narrow at the front, and a sloping top surface, preferably higher at the front. Width Z is measured at the midpoint of length A. The ratio A/Z, and area A×Z, are determined with this midpoint dimension. The maximum width of aiming mark 7 should not exceed 3 times the minimum width. Aiming mark 7 is supported on a top shell portion 30. Top shell 30 is thin so as to transfer weight to weights 23. Aiming mark 7 can be achieved on various other putter heads.

Face 22 is constructed in a substantially elastic fashion in order to increase its energy transfer capabilities. Face 22 is separated by a gap 27 from a front cover surface 24. Face 22 is permanently attached to front cover 24 at the outer edges by an adhesive or by mechanical fasteners that are known. Face 22 may have a surface treatment to reduce its frictional characteristics near strike point 17, such as a PTFE coating. When a ball is struck with a stroke path error, and having these surface characteristics, the combination of high kinetic energy transfer and low surface friction produces a ball motion which tends to follow the direction of face angle more than the direction of putter head motion. Alternatively, it is possible to have a high friction surface for face 22 on a substantially elastic backing. There are other constructions of face 22 possible such as forming or machining gap 27 into a one-piece front cover. Another possibility would be to make front cover 24 with the proper elastic characteristics and either integrate or apply the desired friction characteristic directly to cover 24.

Figure 7:
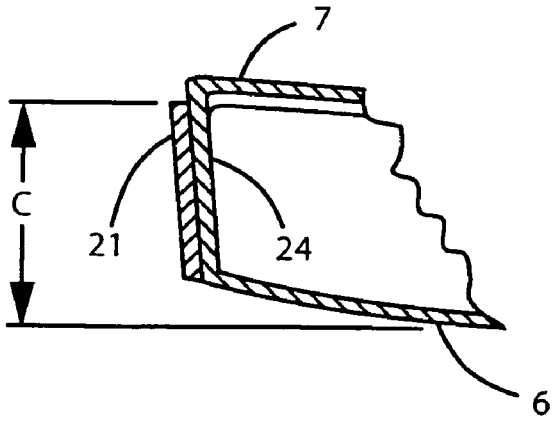
FIG. 7 is a partial cutaway view of an alternate putter face construction.

FIG. 7 shows a different face 21 construction to achieve a different ball motion characteristic. Face 21 may be a partially inelastic material that is adhesively attached to front cover 24. Face 21 material may be chosen for low energy transfer characteristics and high friction. Examples include clutch friction material, tire compound, or various elastomers. When a ball is struck with a putter having face angle error, and having these surface characteristics, the combination of high friction and low kinetic energy transfer produces a ball motion that tends to follow the direction of putter head stroke path. Alternatively, it is possible to have low friction with a partially inelastic material on face 21. Other constructions of face 21 are possible including making cover 24 from a material with the desired friction and adding damping on the inside surface to reduce kinetic energy transfer, or constructing cover 24 from a partially inelastic material.

Both face 21 and face 22 can be achieved on configurations similar to head 1, or on other head configurations. The particular construction is not important. The friction and energy transfer characteristics are the requirements to be achieved.

Figure 8:
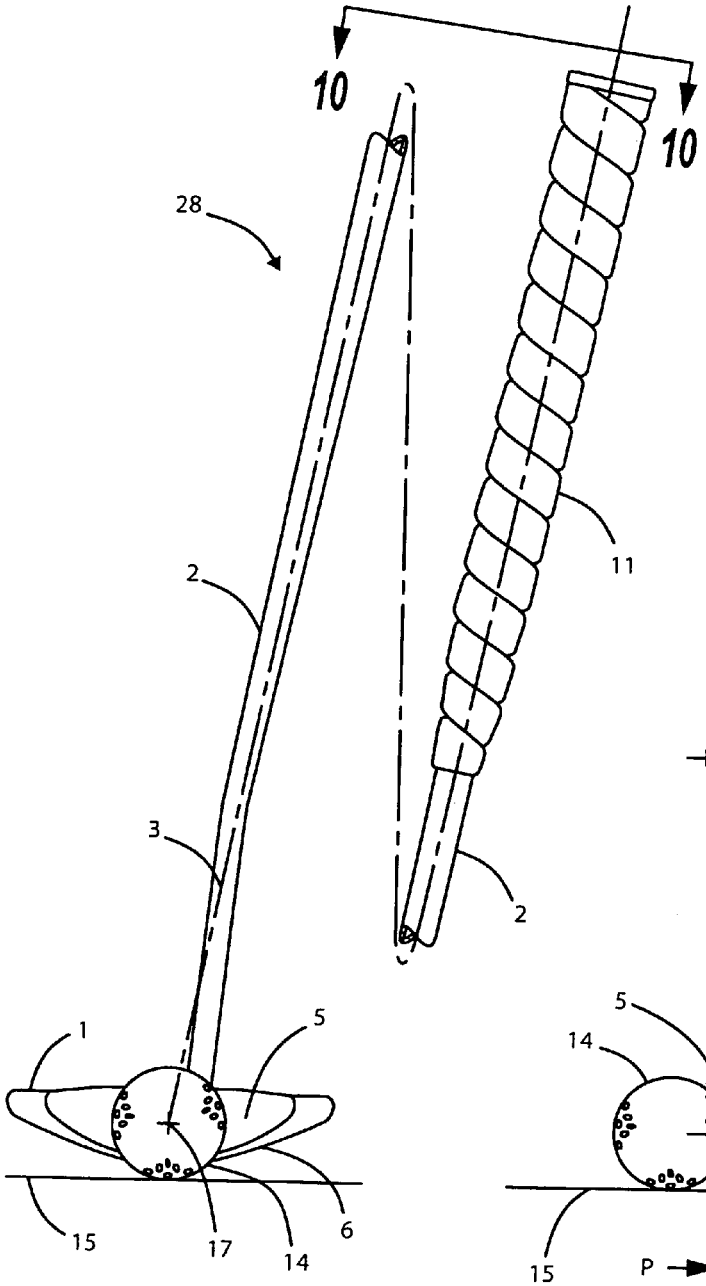
FIG. 8 is a front view of the putter of FIG. 1 together with a separate golf ball, showing the shaft and grip, but with a shaft section removed.
Figure 9:
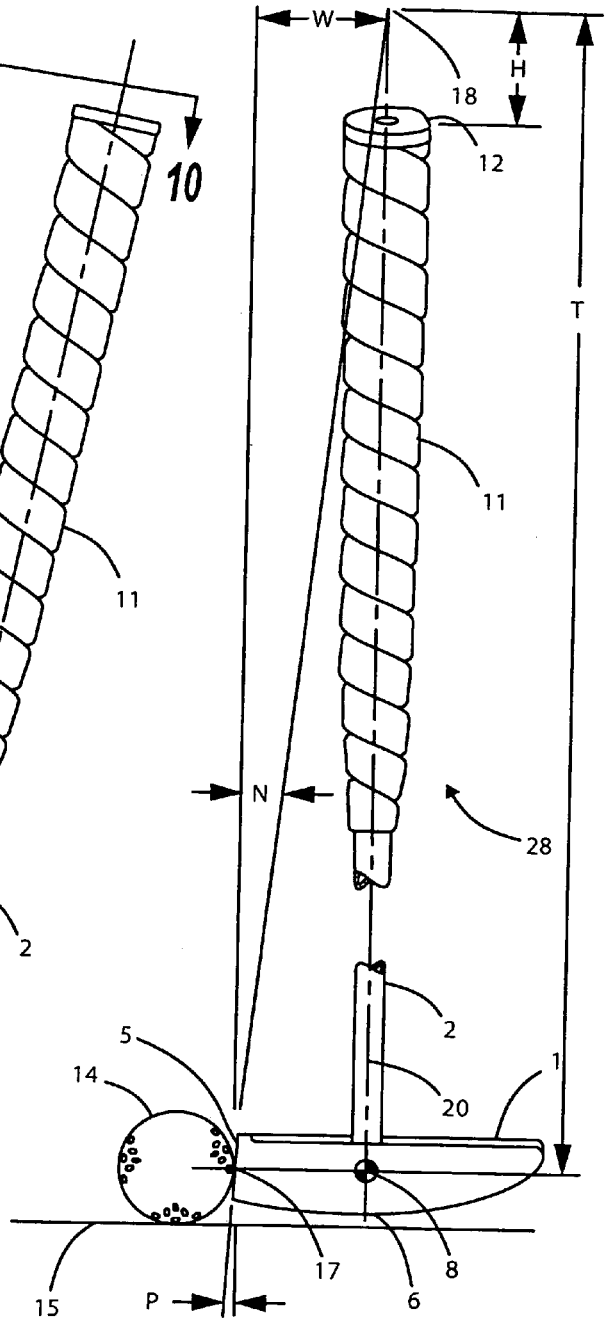
FIG. 9 is a left-side view of the putter and ball of FIG. 8.

Description of the Preferred Embodiment. FIGS. 8 and 9 show putter 28 including head 1, shaft 2 and a grip 11, together with a golf ball 14. Putter 28 is lifted off ground reference 15 and in the striking position. Ball 14 is on ground 15 and in contact with strike point 17 of putter 28. Grip 11 is a commercially available part with an axial flat portion 12 on one side, and preferably is oversized in outside diameter. Several commercially available models are suitable for grip 11 including the POSIWRAP OVERSIZE grip from Positrac. Grip 11 is installed with flat 12 rotated to match the palm position of an individual player's dominant hand when gripping the putter. The description of this embodiment contains the features of the putter of FIGS. 1, 2 and 3, but it applies to head 26 and other heads as well.

A swing pivot point 18 is located in a vertical transverse plane 20 that also passes through center of gravity 8 when using a relaxed player stance. Regardless of where shaft 2 is attached to head 1, this locates pivot point 18 the same distance as c.g. location W behind strike point 17. Transverse plane 20 also passes through the midpoint of grip 11 at the hand position of a player. This ensures that no side force is required to hold putter 28 for use. While transverse plane 20 would normally bisect shaft 2, this is not a necessary condition as the shaft configuration could be unusual.

Having center of gravity 8 under the mid-point of grip 11 and in line with shaft plane 3 ensures that there is no dynamic twisting moment on face 5 whether stroking backward or forward.

A height T locates swing pivot point 18 above strike point 17. Height T can be approximated by club 28 length plus dimension H for purposes of determining a lift angle N. Lift angle N is used, along with the frictional and energy transfer characteristics of face 5, to influence face loft angle P. Dimension H varies somewhat with the style of putter as well as the particular motions of the player. For a conventional free held putter, dimension H is about 16 in. if no wrist bending is used by a player when striking ball 14. Wrist bending would reduce dimension H. For a stomach-supported putter, dimension H is small as pivot point 18 is at or slightly above the end of grip 11. For a pendulum putter, pivot point 18 is about in the middle of an upper portion of grip 11, resulting in dimension H being about −4 in. The net result is that height T is about 40 in. to 50 in. for these three styles of putters. For putter 28 with a c.g. location W of 1.8 in. and height T of 50 in., lift angle N would be 2.1°. If using head 26 of FIG. 4, location X may be about 2.5 in., and lift angle N would be about 2.9°.

When point 17 of putter head 1 strikes ball 14, it tends to have a lifting force as lift angle N is positive. The face loft angle P is also a factor in determining how much ball 14 lifts, or makes increasing ground contact when struck. Other conditions that affect ball motion are the friction and energy transfer characteristics of face 5. These factors interact to determine the launch angle and spin imparted to ball 14 when struck.

Figure 10:
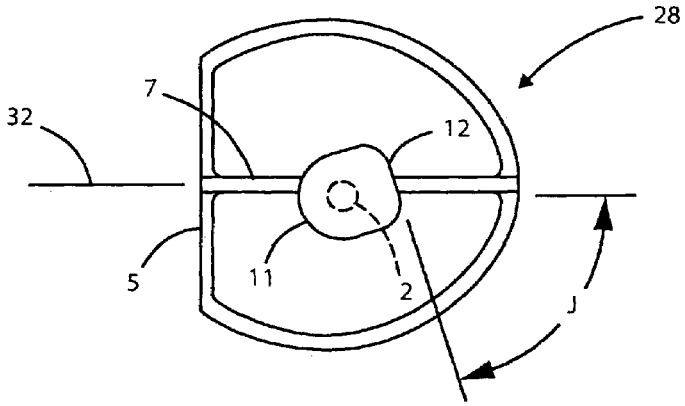
FIG. 10 is a top, axial view of the putter grip of FIG. 8 together with the putter head.

In FIG. 10, grip 11 is generally cylindrical and centered on shaft 2. Flat 12 is rotated at an orientation angle J with reference to aiming mark 7. The function of flat 12 is to easily and repeatably locate putter 28 rotational orientation in a player's hands. When in use, flat 12 is placed against the palm of the dominant hand holding the putter, which then establishes club 28 rotational orientation. The player's other hand then makes a complete grip. The dominant hand is the one which first holds grip 11 when taking a stance, or for pendulum putters the dominant hand is the high one. Orientation angle J of grip flat 12 may be either positive or negative depending on whether the player's right hand or left hand is dominant, and is established for each individual player. The correct angle J is achieved when putter 28 is held with both of the player's hands in a normal stance, with a relaxed grip, and aiming mark 7 is oriented properly with respect to the player's foot position.

The Mechanics of Ball Striking. When a putter strikes a ball with the face and the stroke path perfectly aligned, and centered on the aimline, the force transmitted to the ball is normal to and aligned with the center of the ball. The putter strike force is a combination of kinetic energy force and applied player force. Kinetic energy force is stored in the putter head in proportion to its weight and velocity squared. It can be observed by letting a putter swing freely like a pendulum when striking a ball. The putter slows when striking the ball and the arc of putter follow-through is shortened as it gives up kinetic energy to the ball. Applied player force is caused by the continuous application of effort by a player and can be observed with a long arc of putter follow-through after striking the ball. For short putts, kinetic energy force predominates. For long putts, applied player force is dominant. For a perfectly aligned strike force, the ball motion is all translation and no rotation.

The force actually transmitted to the ball is affected by losses, primarily impact losses in the kinetic energy portion of the putter strike force. Impact losses are determined with a coefficient of restitution r. Coefficient of restitution r is defined as the velocity after impact divided by the velocity before impact with one body stationary. As kinetic energy force varies with the square of velocity, it would vary with coefficient of restitution squared $(r)^2$. Coefficient of restitution r would typically be in the range of 0.71 to 0.85 for a commercially available putter face. The maximum value is established by the available materials and is about 0.85. The minimum value would be determined by player preference and could be as low as desired.

Ball velocity after impact would be less by coefficient r applied to the kinetic energy force component of the strike force. Lower values of coefficient r result in lower ball velocity. The applied player force component of the strike force would be used in full. For short putts, with kinetic energy force predominant, the energy recovered by the ball could be low for low values of coefficient r. For long putts, with player force dominant, energy delivered to the ball would be relatively higher.

When the putter face is misaligned with the stroke path, the strike force is not normal to the ball and does not pass through its center. This condition could be due either to twisting of the putter face or from misalignment of the stroke path with the aimline. This misaligned condition results in the ball traveling off the aimline. The actual path of ball travel is determined by the amount of misalignment, the friction and energy transfer characteristics of the striking face, and by the forces delivered by the striking face.

The primary velocity component of the ball is in the direction of the strike force. When the strike force does not pass through the center of the ball, a tendency is created for the ball to slide and roll along the putter face in the direction of the lagging portion of the face surface. Both sliding and rotation tend to induce a velocity component in that same direction, and change the direction of ball motion. The result is ball velocity in a direction away from the swing path and more perpendicular to the putter face. Both sliding and rolling are affected by a coefficient of friction f of the putter face with the ball. In addition, there may be a bounce component of velocity that is affected by coefficient of restitution r.

Static coefficient of friction f is defined as the tangential force divided by the normal force under conditions of impending motion. A dynamic coefficient of friction would be less than static coefficient f, and would be subject to variations that depend on the conditions. Static coefficient f varies between about 0.23 and 0.32 for commercially available putter faces and it depends on the material. The minimum value for coefficient f is about 0.12 and could be more than 0.40 if desired.

Stroking error angles are small, usually less than 7°, producing a tangential force that is less than 0.12 times the normal force. Under static conditions, the available tangential force would always be less than the friction force, and the ball would not slide along the putter face. Under the dynamic conditions of putting a ball, the apparent coefficient of friction is reduced, and limited sliding occurs. This sliding is proportional to coefficient f within a range of values. Above a threshold value for coefficient f, the sliding is not proportional.

Rolling along the putter face takes more energy than sliding if below the threshold for coefficient f. The ball rotational inertia about the contact point is higher than the translational inertia. The effect of this is to reduce the sliding tangential velocity component as the coefficient f increases, and increase the rotational component. The rotational component resolves into tangential velocity in the same direction as the sliding velocity, but is smaller. The ball direction is changed less from the stroke path at higher values for coefficient f, up to the threshold value for coefficient f. At this point, all tangential motion is rolling and higher values for coefficient f no longer affect ball direction. The range of threshold values for coefficient f is about 0.25 to 0.40, and the value may depend on the strike force and the putter face angle. Longer putts and higher error angles tend to have higher thresholds for coefficient f.

High energy transfer surfaces may exhibit a bounce characteristic. Bounce is the tendency for a moving object that impacts an angled surface to leave it at the negative of the approach angle. This is usually observed with the bouncing object impacting a stationary surface, but the compressibility of the golf ball may produce a bounce effect with the putter face moving. Bounce would also influence the ball direction in a manner away from the stroke path. The amount of bounce would be proportional to coefficient of restitution r and the kinetic energy of impact. Short, low force putts have a higher percentage of kinetic energy than long putts. At a high percentage of kinetic energy and high values of coefficient r, the ball translation could even overshoot being at a right angle to the putter face.

Figure 11A:
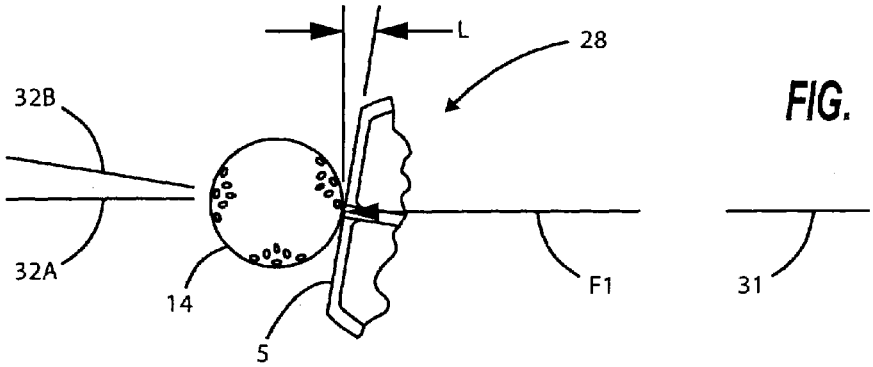
FIG. 11A is a diagram of a golf ball and partial putter head during a mis-hit, and the strike force, looking from the top.

Results of Mis-hits. In FIG. 11A, a strike force F1 is shown looking down on ball 14 and face 5. Force F1 is in a vertical plane passing through stroke path 31 and a nearly horizontal plane at lift angle N. Face 5 of putter 28 is rotated out of a right angle with stroke path 31 by error angle L, resulting in unwanted forces tending to send ball 14 off the aimline. Error angle L is magnified for clarity. This could be the result of face 5 being rotated clockwise by error angle L, with swing path 31 being coincident or parallel to aimline 32A. It could also result from swing path 31 of putter 28 being misaligned with aimline 32B counterclockwise by error angle L, and face 5 being at a right angle to aimline 32B. It could also be a combination of both. Many experts believe, that for each player, one error is more consistently committed than the other, and the magnitude and frequency depends on the skill level of that player. Player stroking errors can also vary with the length of putts, sometimes with short putts having more error than longer putts. This condition is sometimes known as the yips. Which error is prevalent, and when, can be tested by an expert.

Figure 11B:
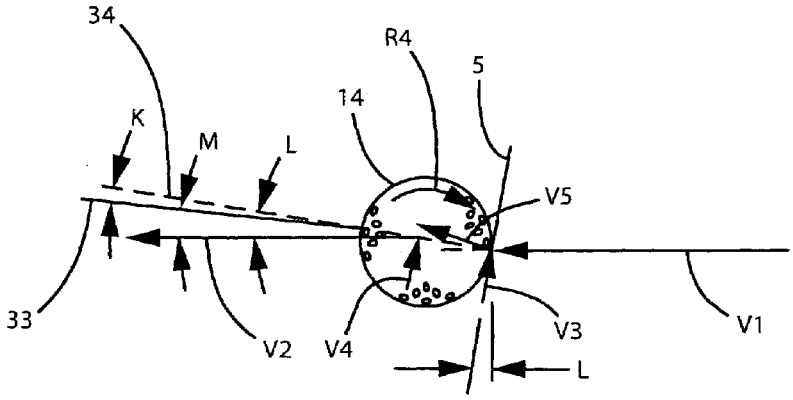
FIG. 11B is a vector diagram of the ball of FIG. 11A showing velocity components after impact.

In FIG. 11B, a strike velocity vector V1 of strike force F1 impacts ball 14 with face 5. The direction of velocity V1 does not pass through the center of ball 14. A normal line 34 is perpendicular to face 5, and passes through the center of ball 14 and the contact point of ball 14 with face 5. Face 5 is at error angle L with a plane at a right angle to velocity V1. A ball motion line 33 establishes the direction that ball 14 leaves the putter face 5. A drag angle K measurers the difference between normal line 34 and ball motion line 33.

A release velocity vector V2 is in the same direction as strike velocity V1 and is substantially the forward component of ball 14 velocity. The release velocity vector V2 does not measure the direction of ball 14 however. Release velocity V2 is less than velocity V1 by the impact loss in the kinetic energy portion of strike force F1. This impact loss is measured by coefficient of restitution r acting on the kinetic energy portion of strike force F1. Release velocity V2 is at error angle L to normal line 34. A release angle M measures ball 14 direction relative to release velocity V2. Release angle M is error angle L minus drag angle K.

Because strike velocity V1 does not pass through the center of ball 14, a reaction is created at ball 14 that slides it to the right on face 5. The speed of sliding is inversely proportional to coefficient of friction f, and is represented by a slide velocity vector V3. Slide velocity V3 is tangent to face 5 and in a generally right-hand direction. There would also be some rotation of ball 14 to the right, depending on the energy used in sliding. This motion is represented by a rotation velocity R4, which is clockwise. Rotation velocity R4 converts to a translation velocity vector V4 shown at the center of ball 14, and its direction is parallel to face 5 and to the right. Translation velocity V4 is proportional to coefficient f as it increases when slide velocity V3 is reduced. The sum of velocities V3 and V4 increases with decreasing friction coefficient f. This produces an increasing tendency for ball 14 motion away from stroke path 31, and closer to normal line 34, as coefficient f decreases.

A bounce velocity vector V5 is at error angle L on the opposite side of normal line 34 from velocity V2. The value of bounce velocity V5 is proportional to coefficient of restitution r and the kinetic energy portion of strike force F1. This produces ball 14 motion to the right and away from normal line 34, and would increase at higher values of coefficient r. Relative to release velocity V2, bounce velocity V5 is proportionally higher on short, low force putts.

Ball motion line 33 is on the vector sum of vectors V2, V3, V4 and V5. Line 33 direction would be near to release velocity V2 for high friction, low energy transfer surfaces, and release angle M would be low. For low friction, high energy transfer surfaces, ball motion line 33 would near to normal line 34, and drag angle K would be low. For low force putts, drag angle K could be negative if bounce vector V5 gets relatively large.

Drag angle K measures the direction of ball motion line 33 from normal line 34. Drag angle K would be the deviation from aimline 32 when the error angle L is with stroke path 31 and face 5 alignment is correct. If stroke path 31 is counterclockwise from aimline 32, drag angle K would be counterclockwise. Drag angle K decreases with lower friction on face 5, as ball 14 direction is not greatly influenced away from normal line 34. A lower coefficient of friction f helps to correct for errors in stroke path 31.

Release angle M would be the deviation from aimline 32 when the error angle L is with face 5 being out of perpendicular to aimline 32, and the swing path 31 is correct. For a stroke in which face 5 was twisted clockwise by error angle L, ball motion line 33 would be at release angle M clockwise from aimline 32. Release angle M decreases with higher friction coefficient f on face 5 as ball 14 direction is influenced closer to stroke path 31.

In terms of putter 28 parameters, drag angle K is proportional to error angle L and coefficient of friction f. Also, drag angle K varies inversely with coefficient of restitution r. Release angle M is error angle L minus drag angle K. The summation of these velocity vectors and resulting translation motion of ball 14 can be determined by measuring angles L, K, and M with a range of values for coefficients f and r.

Figure 12:
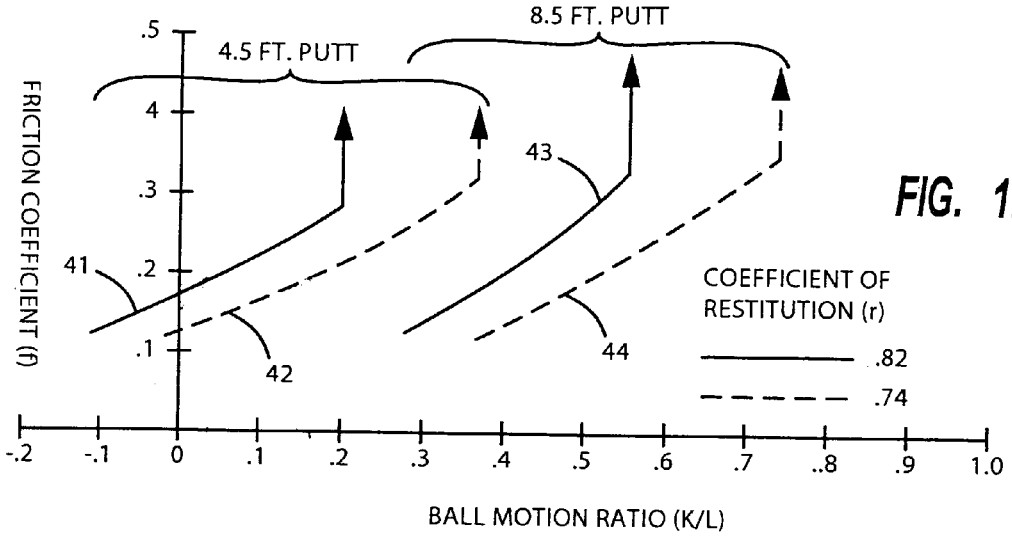
FIG. 12 is a graph of a ratio of ball travel direction vs. putter face coefficient of friction at two strike force levels.

In FIG. 12, on the horizontal axis, a ball motion ratio K/L measures the ratio of drag angle K to error angle L. A value for ratio K/L of 1.0 would represent ball motion in the direction of stroke path 31. A value for ratio K/L of 0.0 represents ball motion at a right angle to face 5, in the direction of normal line 34. On the vertical axis, friction coefficient f indicates the static friction of face 5 with ball 14.

Line 41 shows the relationship of coefficient f and ratio K/L for a low force putt of about 4.5 ft. Line 41 is with a high energy transfer face material, having coefficient r of about 0.82. The threshold value for coefficient f is about 0.30 for line 41. Line 42 is a low force putt with a low energy transfer face material, having coefficient r of about 0.74. Line 43 is a higher force putt, about 8.5 ft, with a high energy transfer face, the same as line 41. Line 44 is a higher force putt with a low energy transfer face material, the same as line 42. The threshold value for coefficient f is about 0.37 for line 44.

Low friction at the putter face produces ball motion that follows face angle more than stroke path, especially on short putts. Errors relative to face angle are near zero for short putts. As putts increase in length, the ball direction changes more toward the stroke path, but only deviates about 0.28 to 0.37 from the face angle error, depending on energy transfer characteristics. The least deviation from a face normal line is with a high energy transfer face.

High friction at the putter face produces ball motion biased more toward stroke path than with low friction. On short putts, the deviation from stroke path is 0.62 to 0.80, the smaller deviation being with a low energy transfer face. On longer putts, the deviation is 0.26 to 0.44 from stroke path, the smaller value again with a low energy transfer face. Putts longer than shown would have higher values of ratio K/L vs. coefficient f, and higher threshold values for coefficient f.

Figure 13A:
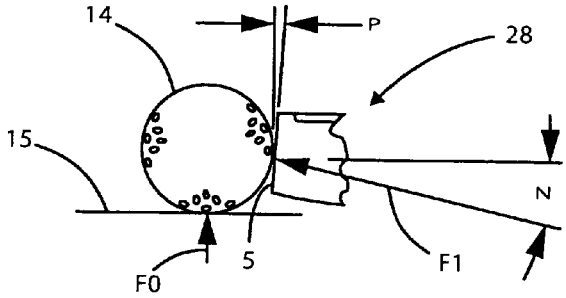
FIG. 13A is a diagram of a golf ball and putter face at the time of a strike, and the strike force, looking from the left side.

Face Loft Angle. In FIG. 13A, strike force F1 is in a vertical plane passing through stroke path 31 and in a nearly horizontal plane at lift angle N. Force F1 is the same force as in FIG. 11A, but shown in a vertical plane. Face 5 of putter 28 is at a loft angle P which is positive but less than lift angle N. Loft angle P could be zero or negative. Angles N and P are magnified for clarity. Force F1 does not pass through the center of ball 14, which tends to influence the direction of translation and the rotation of ball 14. Because of contact with ground 15, there is a gravity force F0 acting on ball 14. For all but very low force putts, gravity force F0 is much smaller than strike force F1, and it is not a factor in ball 14 motion.

Figure 13B:
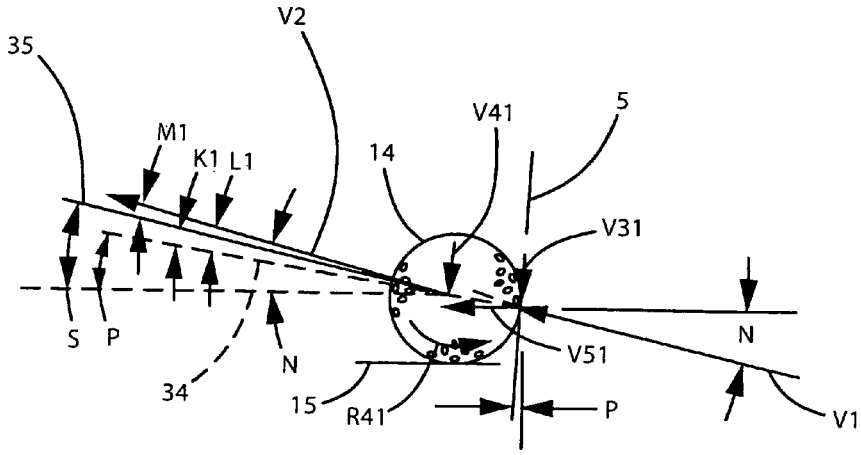
FIG. 13B is a vector diagram of the ball of FIG. 13A, showing velocity components after impact.

In FIG. 13B, the velocity vector V1 is the same vector from FIG. 11B except that it is shown from the side and not the top. It is in the same direction as strike force F1. The direction of velocity V1 does not pass through the center of ball 14. Normal line 34 is the same as identified in FIG. 11B, except that it is at loft angle P measured from horizontal in this view. A ball motion line 35 establishes the direction, in a vertical plane, that ball 14 leaves the putter face 5. A drag angle K1 measures the difference in normal line 34 and ball motion line 35 in a vertical plane.

The release velocity vector V2 is the same vector as shown in FIG. 11B except that it is shown in a vertical plane. It is in the same direction as strike velocity V1 and is substantially the forward component of ball 14 velocity. Release velocity V2 is at a net lift angle L1 to normal line 34. Net lift angle L1 is equal to lift angle N minus loft angle P. A release angle M1 measures ball 14 direction relative to release velocity V2. Release angle M1 is at net lift angle L1 minus drag angle K1.

The angles K1, L1, and M1, respectively, are similar to angles K, L, and M from FIG. 11B, except that they are in the vertical plane. They have the same relationship mathematically. Similarly, velocity vectors V31, V41 and V51, respectively, have the same relationship to V1 and V2 as vectors V3, V4 and V5 from FIG. 11B. The directions are opposite because net lift angle L1 is opposite error angle L. Ball motion line 35 is on the vector sum of vectors V2, V31, V41 and V51. Ratio K1/L1, and motion line 35, may be determined from FIG. 12 the same as for determining motion line 33. Ball 14 direction of translation in three-dimensional space is between line 33 and line 35. It is measured by the vector sum of V2, V3, V4, V31, V41, and the average of V5 and V51.

A launch angle S measures ball 14 initial trajectory relative to ground 15. Launch angle S is lift angle N minus release angle M1, or equivalently, loft angle P plus drag angle K1. For most putts, launch angle S should be greater than zero. In a manner similar to the analysis for FIGS. 11A and 11B, launch angle S can be determined from the friction and energy transfer parameters of face 5 and the dimensions of putter 28. At low coefficient f for face 5, loft angle P may be greater than zero, but need not be more than 0.09 angle N, to achieve positive launch angle S. For putter 28 with c.g. location W of 1.8 in., loft angle P would be at least 0.2°. At high coefficient f, loft angle P can be negative by up to −0.25 angle N to achieve positive launch angle S. For putter 28 with head 26 having a c.g. location W of 2.5 in., loft angle P would be at least −0.7°. Higher coefficient f, lower coefficient r, and less positive loft angle P tend to induce more counterclockwise rotation, or forward roll on ball 14.

Launch angle S increases at higher values of friction coefficient f as ball 14 slides less and rotates more. Maximum roll of ball 14 would be produced at the threshold friction and the most negative loft angle P. Skidding of ball 14 is lowest at the highest roll, and speed control is the best.

The ratio K1/L1 varies with putt distance, which means that the launch angle varies with putt distance. For players who desire to damp the motion of ball 14 on short putts, a value for coefficient f could be selected in combination with a low loft angle P to produce a negative launch angle S. For short putts, if selected appropriately, this same combination would produce a positive value for launch angle S on longer putts. This would have the effect of varying ball 14 damping with the stroking force, a condition sometimes desired for better speed control of short putts.

Loft angle P could be larger than lift angle N. This would produce positive values for launch angle S under all conditions. Loft angle P greater than lift angle N would also tend to produce backward rotation of ball 14.

Use of the Putter

After determining aimline 32, a player would place his or her feet in the approximate final stance position. Holding putter 28 in his or her dominant hand, the player would place flat 12 of grip 11 against the palm of that hand in the accustomed position. Flat 12 helps to relocate that accustomed hand position and consistently establish face 5 rotation. Taking putter 28 with the other hand, the player takes a stance and re-sights on aimline 32. As the player's eyes are both behind ball 14 over aimline 32, an accurate vision of the aimline 32 and ball 14 with aiming mark 7 is facilitated.

The player's foot position may be adjusted to achieve both proper alignment with aiming mark 7 and a comfortable posture. The foot spacing relative to the aimline 32 is not restricted by putter 28. Sole 6 radius is small enough to stand close to aimline 32, or on a sidehill, or to stand far away from aimline 32. A stance with the eyes vertically over aimline 32 and aiming mark 7, and the muscles relaxed, is preferred. Head 1 is approximately centered longitudinally in the stance, with ball 14 in the front part of the stance. Aiming mark 7 is aligned with ball 14 and aimline 32, and the feet may be readjusted. Aiming mark 7 is used to position the feet both transversely and longitudinally. Aiming mark 7 is sized for clear visibility, is bright and highly directional, and has minimum distraction to assist in focusing the eyes and the mind. Putter 28 has improvements in most areas where it comes into physical or mental contact with the player, or with the ground, to aid in taking an accurate and consistent stance.

When a player is ready to stroke putter 28, the intent is for stroke path 31 and aiming mark 7 to be in alignment with aimline 32. When ball 14 is struck, these elements should remain in alignment, and head 1 speed should be the correct amount. Accomplishing this requires precise control of the muscles supporting and stroking putter 28. The fewer muscles used in supporting and stroking putter 28, the more likely the outcome will be accurate. Putter 28 places center of gravity 8 vertically in the center of the stance, and allows the player's feet to be near to aimline 32. This facilitates a relaxed, upright stance with the arms hanging and the back and leg muscles having minimum tension. The arms and back are the primary muscles performing the putting action and these have limited athletic requirements with putter 28. When a stance is set, the player takes a backstroke with putter 28 and then a downstroke, and strikes ball 14. Because center of gravity 8 is under grip 11 mid-point, and in line with shaft plane 3, there is no tendency for face 5 of putter 28 to twist during the backstroke or the downstroke.

When putter 28 strikes ball 14, its direction and speed will be influenced by the accuracy of the putting stroke. A perfect stroke will result in ball 14 holing out. Small errors can add strokes. For example, a 3° error in direction would produce a deviation of 2.8 in. for 4.5 ft. of travel. A golf hole has 2.13 in. radius.

For a player with a tendency to have stroke path 31 errors, putter 28 could be supplied with face 5 having low friction and high energy transfer characteristics. With putter 28 having face 5 with coefficient of friction f of 0.12 and coefficient of restitution r of 0.82, drag angle K from aimline 32 would be reduced. With a short putt and stroke path 31 error of 3.0°, drag angle K would be about −0.4°, or 0.4 in. deviation in 4.5 ft. of travel. With a longer putt, the drag angle K would be about 0.8°, or about 1.4 in. for 8.5 ft. of travel, with the same stroke path error. If face 5 angle were accurate, both putts would be holed.

For a player with a tendency to have face angle errors when stroking, putter 28 could be supplied with a coefficient of friction f of 0.40 and coefficient of restitution r of 0.74. With these characteristics for face 5, release angle M from aimline 32 would be reduced. With a player induced face 5 error of 3.0°, release angle M would be about 2.2° with a short putt, or about 1.9 in. deviation for 4.5 ft. of travel. With a longer putt, the release angle M would be about 0.8°, or about 1.4 in. deviation for 8.5 ft. of travel. If stroke path 31 were accurate, both putts would be holed.

When using putter 28, ball 14 deviation from aimline 32 resulting from a stroking error is reduced by selecting the correct combination of friction and energy transfer for face 5. When the friction and energy transfer characteristics of face 5 are matched to the particular swing error of the player, the percentage of golf balls holed is increased.

Because c.g. location W is large, lift angle N is large. Regardless of coefficient of friction f selected, face loft angle P can be small or negative, and so induce some rolling of ball 14. For appropriate combinations of values for coefficient f, coefficient r, and loft angle P, putter 28 could be used to damp the speed of short putts with ground 15 and launch ball 14 freely with longer putts.

In the event of an off-center hit, the tendency for face 5 to rotate is reduced because the polar moment of inertia is increased. Center of gravity 8, which is the center of the kinetic energy force, and the center of applied player force, are both in line with ball strike point 17. This further reduces the tendency for face 5 to rotate when striking ball 14. Putter 28 helps imperfect players hole more putts.

The invention claimed is:

1. A putter comprising a head and an attached shaft, said head including a face and having a length extending from said face to a rear edge, said shaft having a grip at the opposite end from said head, said head having a center of gravity located at least 40% of said head length behind said face, said shaft having an axis at a predetermined lie angle to a vertical longitudinal plane, a vertical transverse plane passing through a midpoint of said grip, a distance between said face and said transverse plane establishing a lift angle for striking a ball, wherein said distance is at least 55% of said head length behind said face, said head length is at least 3.0 inch, and said lie angle is at least 10°.

2. The putter of claim 1 including said face disposed at a predetermined loft angle to the transverse plane, wherein said loft angle is less than the lift angle.

3. The putter of claim 1, wherein the transverse plane intersects said center of gravity.

4. The putter of claim 1, said grip comprising an axial flat portion, wherein said flat portion is rotationally disposed non-perpendicular to said face.

5. The putter of claim 1, said face comprising an intended ball strike area surrounding its center, wherein said ball strike area is a different material than said head to predetermine a coefficient of restitution of said face.

6. The putter of claim 1 including said face comprising an intended ball strike area surrounding its center, wherein said ball strike area has a different material than said head to predetermine a coefficient of friction on said surface.

7. A putter comprising a head and an attached shaft, said head including a front face and a bottom sole with a lowest sole area, said shaft with a grip on the opposite end of said head, said head with a longitudinal vertical plane perpendicular to said face, said shaft at a lie angle of at least 10° to the longitudinal vertical plane, said sole having a surface with a shape in the longitudinal plane direction, said surface extending forward from a start at the lowest sole area to a termination at said front face, said termination at a vertical rise above said lowest sole area, a vertical transverse plane passing through an axial midpoint of said grip, a location of said transverse plane behind said face establishing a lift angle, wherein a distance from said front face to said start is at least 1.2 inch and the location of said transverse plane behind said front face is at least as great as said distance.

8. The putter of claim 7 wherein said rise is 0.13 inch or less.

9. The putter of claim 7, including said front face comprising an intended ball strike point substantially at its center, the vertical longitudinal plane passing through said strike point, said shaft having a substantially straight axis, wherein the shaft axis intersects the longitudinal plane at a vertical height of said strike point.

10. The putter of claim 7, including said front face comprising an intended ball strike point substantially at its center, said head having a center of gravity, wherein said center of gravity is at a vertical height of said strike point.

11. The putter of claim 7 including said head having a center of gravity, wherein the transverse plane passes through said center of gravity.

12. A putter comprising a head and an attached shaft, said head including a front face and a bottom sole, said shaft having a grip on the opposite end from the head, said head having a longitudinal vertical plane perpendicular to said face, said shaft at a lie angle of at least 10° to the longitudinal vertical plane, said sole having a lowest point in the longitudinal vertical plane, said sole comprising a convex, curved surface in the longitudinal plane with a termination at said front face and extending rearward from said lowest point, said lowest point at a distance to the rear of said front face, wherein said curved surface is substantially inside a 50 inch radius that passes through said lowest point, said grip having an axial midpoint, wherein said midpoint has a longitudinal location behind said front face at least as great as said distance from said front face, and said distance is at least 1.2 inch.

13. The putter of claim 12 wherein said curved surface is substantially outside a 25 inch radius from said lowest point to said front face and said 25 inch radius passes through said lowest point.

14. The putter of claim 12 including said head having a center of gravity, wherein a longitudinal location for said center of gravity is substantially the same as said midpoint location.

15. The putter of claim 12, the midpoint location establishing a lift angle for striking said ball, said face disposed at a predetermined loft angle to a transverse plane, wherein said loft angle is less than the lift angle.

* * * * *